US006034650A

United States Patent [19]

Kuramoto

[11] Patent Number: 6,034,650

[45] Date of Patent: Mar. 7, 2000

[54] SMALL HELICAL ANTENNA WITH NON-DIRECTIONAL RADIATION PATTERN

[75] Inventor: Akio Kuramoto, Tokyo, Japan

[73] Assignee: NEC Corporation, Tokyo, Japan

[21] Appl. No.: 09/038,283

[22] Filed: Mar. 11, 1998

[30] Foreign Application Priority Data

Mar. 14, 1997 [JP] Japan ..... 9-060796

[51] Int. Cl.[7] ..... H01Q 1/36; H01Q 1/24; H01Q 11/00

[52] U.S. Cl. ..... 343/895; 343/702; 343/843

[58] Field of Search ..... 343/895, 700 MS, 343/702, 843, 866, 867, 870

[56] References Cited

U.S. PATENT DOCUMENTS

| | | | |
|---|---|---|---|
| 5,467,096 | 11/1995 | Takamoro et al. | 343/702 |
| 5,541,617 | 7/1996 | Connelly et al. | 343/895 |
| 5,668,559 | 9/1997 | Baro | 343/702 |
| 5,678,201 | 10/1997 | Thill | 455/562 |
| 5,706,019 | 1/1998 | Darden, IV et al. | 343/895 |
| 5,754,156 | 5/1998 | Knowles et al. | 343/895 |
| 5,828,348 | 10/1998 | Tassoudji et al. | 343/895 |

FOREIGN PATENT DOCUMENTS

| | | |
|---|---|---|
| 0 320 404 | 6/1989 | European Pat. Off. . |
| 0 805 513 | 11/1997 | European Pat. Off. . |
| 8-78945 | 3/1996 | Japan . |
| WO 92/05602 | 4/1992 | WIPO . |
| WO 97/41695 | 11/1997 | WIPO . |
| WO 98/05087 | 2/1998 | WIPO . |

OTHER PUBLICATIONS

By A. Sharaiha et al., "Printed quadrifilar resonant helix antenna with intergrated feeding network", *Electronics Letters*, vol. 33, No. 4, Feb. 13, 1997, pp. 256–257.

*Primary Examiner*—Don Wong
*Assistant Examiner*—Jennifer H Malos
*Attorney, Agent, or Firm*—Young & Thompson

[57] ABSTRACT

A small helical antenna with broad fan radiation pattern provides easy impedance matching and high radiation efficiency. It is composed of a dielectric cylinder, a plurality of radiation conductors arranged on the outer surface of the dielectric cylinder, a matching conductor arranged on the upper inner surface of the dielectric cylinder that cancels inductive reactance, and a plurality of feeder conductors arranged near the radiation conductors on the lower inner surface of the dielectric cylinder and lowering the impedance of the helical antenna.

23 Claims, 9 Drawing Sheets

SMALL HELICAL ANTENNA WITH NON-DIRECTIONAL RADIATION PATTERN

BACKGROUND OF THE INVENTION

1. Field of the Invention

The present invention relates to a helical antenna for wireless communication, and more particularly relates to a small helical antenna with a broad fan radiation pattern for a mobile terminal in mobile satellite communication or ground mobile communication and the like.

2. Description of the Related Art

A conventional helical antenna is disclosed in Japanese Published Unexamined Patent Application No. 8-78945 (78945/1996). FIG. 7 shows a perspective view of this helical antenna at 100.

The helical antenna 100 according to the prior art comprises a dielectric cylinder 104 and a flexible printed wiring sheet 107, which is wound around the dielectric cylinder 104, and is equipped with two helical balanced conductors 101 and 101'.

An unbalanced RP signal (Radio Frequency signal) in a coaxial cable 105 is converted to a balanced RP signal by a balun 108.

After that, the balanced RF signal is fed to each of the two helical balanced conductors 101 and 101'.

FIG. 8 shows an assembly procedure of the helical antenna 100 shown in FIG. 7. As shown in FIG. 8, the two balanced helical conductors 101 and 101' are adhered to the flexible printed wiring sheet 107 by a pressure sensitive adhesive double coated tape 103.

FIG. 9 illustrates a perspective view of a metal conductor 106 of the helical antenna 100 shown in FIG. 7. The end portions of the helical conductors 101 and 101' are short-circuited by a straight metal conductor 106. The metal conductor 106 secures the helical conductors 101 and 101' to enhance their mechanical strength and achieves an impedance matching of the helical antenna 100.

FIG. 10 illustrates a perspective view of the metal conductor 106 of another shape. That is, the shape of the metal conductor 106 shown in FIG. 10 is bent and suitable for achieving the impedance matching. In this case, the impedance matching of metal conductor 106 can be done comparatively easily by changing or adjusting the shape of its bent part.

In the above description, the two types of the metal conductor 106 shown in FIGS. 9 and 10 are preferred mainly for easy impedance matching and strong mechanical strength.

However, the helical antenna 100 of the prior art is not necessarily able to provide feeder impedance matching for all the helical conductors.

That is, the helical antenna 100 of the prior art is very effective for a helical antenna having a comparatively long helical conductor with two or more turns. However, in the case of a helical antenna having a broad fan radiation pattern for the mobile terminal etc., usually, the helical conductors 101 and 101' each have a length of only 1.5λ (λ is a wavelength of an operating frequency) and their number of turns is two or less. In this case, the feeder impedance frequency bands of the helical conductors 101 and 101' which are capable of adjusting the impedance matching by the metal conductor are very narrow. As a result, it is impossible to achieve the feeder impedance matching of the helical antenna 100 in a wide frequency band.

SUMMARY OF THE INVENTION

Therefore, it is an object of the present invention to attain easy electrical impedance matching, to improve a voltage standing wave ratio (VSWR) and to increase a radiation efficiency and an antenna gain of a helical antenna having short helical conductors and a relatively low number of turns.

The helical antenna of the present invention comprises a plurality of radiation conductors arranged on the outer wall of a dielectric cylinder, a plurality of feeder conductors supplying a high frequency signal through an electrostatic coupling to a respective first end of each of the plurality of radiation conductors in different phases on the inner wall of the dielectric cylinder, and a matching conductor electrostatically coupled with their opposite second ends.

In an alternative embodiment, the matching conductor may be omitted.

In a further embodiment, the helical antenna of the present invention comprises a plurality of radiation conductors arranged on the outer wall of the dielectric cylinder, feeder means supplying the high frequency signal directly to each of a plurality of radiation conductors in different phases on the inner wall of said dielectric cylinder, and a matching conductor electrostatically coupled with their opposite ends.

As described above, the present invention attains an electrical impedance matching by one or both of the following techniques:

(1) A matching conductor is mounted on the inner wall of the cylindrical conductor forming the helical antenna equipped with a plurality of the radiation conductors on the surface thereof.

(2) Feeder conductors in the same number as that of a plurality of the radiation conductors are arranged closely with each other for feeding the high frequency signal to the helical antenna on the inner wall of the cylindrical conductor forming the helical antenna equipped with a plurality of radiation conductors on the surface thereof.

BRIEF DESCRIPTION OF THE DRAWINGS

The present invention will be described in further detail with reference to the accompanying drawings, in which.

DETAILED DESCRIPTION OF PREFERRED EMBODIMENTS OF THE INVENTION

Several embodiments of the present invention will be described with reference to the accompanying drawings.

Figure 1:
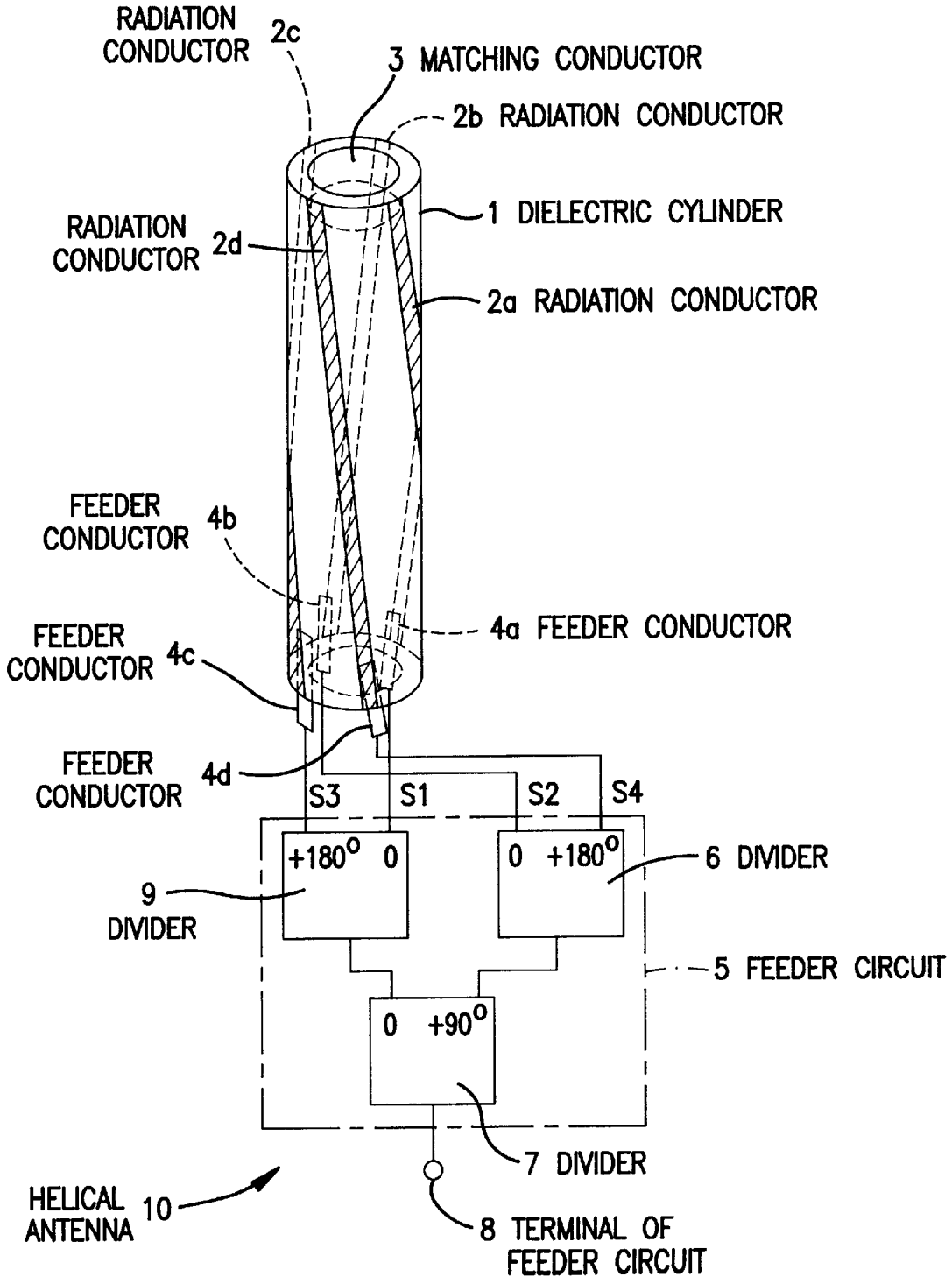
FIG. 1 is a perspective view of a helical antenna 10 of a first embodiment according to the present invention.

Referring to FIG. 1, a preferred embodiment of the present invention is composed of a dielectric cylinder 1; four radiation conductors 2*a*, 2*b*, 2*c*, 2*d* arranged on the outer surface of the dielectric cylinder 1; a matching conductor 3 arranged on the upper inner surface of the dielectric cylinder 1; four feeder conductors 4*a*, 4*b*, 4*c*, 4*d* arranged facing the radiation conductors 2*a*–2*d*; and a feeder circuit 5 for feeding four high frequency signals to the feeder conductors 4*a*, 4*b*, 4*c*, 4*d* with 90 degrees phase difference from each other.

The operation of an antenna element according to the present invention will be described below with reference to the drawings.

In FIG. 1, there is an electrostatic capacitance across the thickness of the dielectric cylinder 1 between the matching conductor 3 and the radiation conductors 2*a*–2*d*. Therefore, both the matching conductor 3 and the radiation conductors 2*a*–2*d* are coupled with each other over a high frequency range. That is, the radiation conductor 2*a* is effectively coupled not only with the matching conductor 3 but also with the radiation conductors 2*b*–2*d* in a high frequency range. Therefore, even though the feeder impedance of the radiation conductor 2*a* alone is high, such high feeder impedance of the radiation conductor 2*a* can be decreased by adjusting the width and the position of the matching conductor 3 and by adjusting the high frequency coupling degree between them. As a result, an adequate electrical impedance matching can be achieved.

Figure 7:
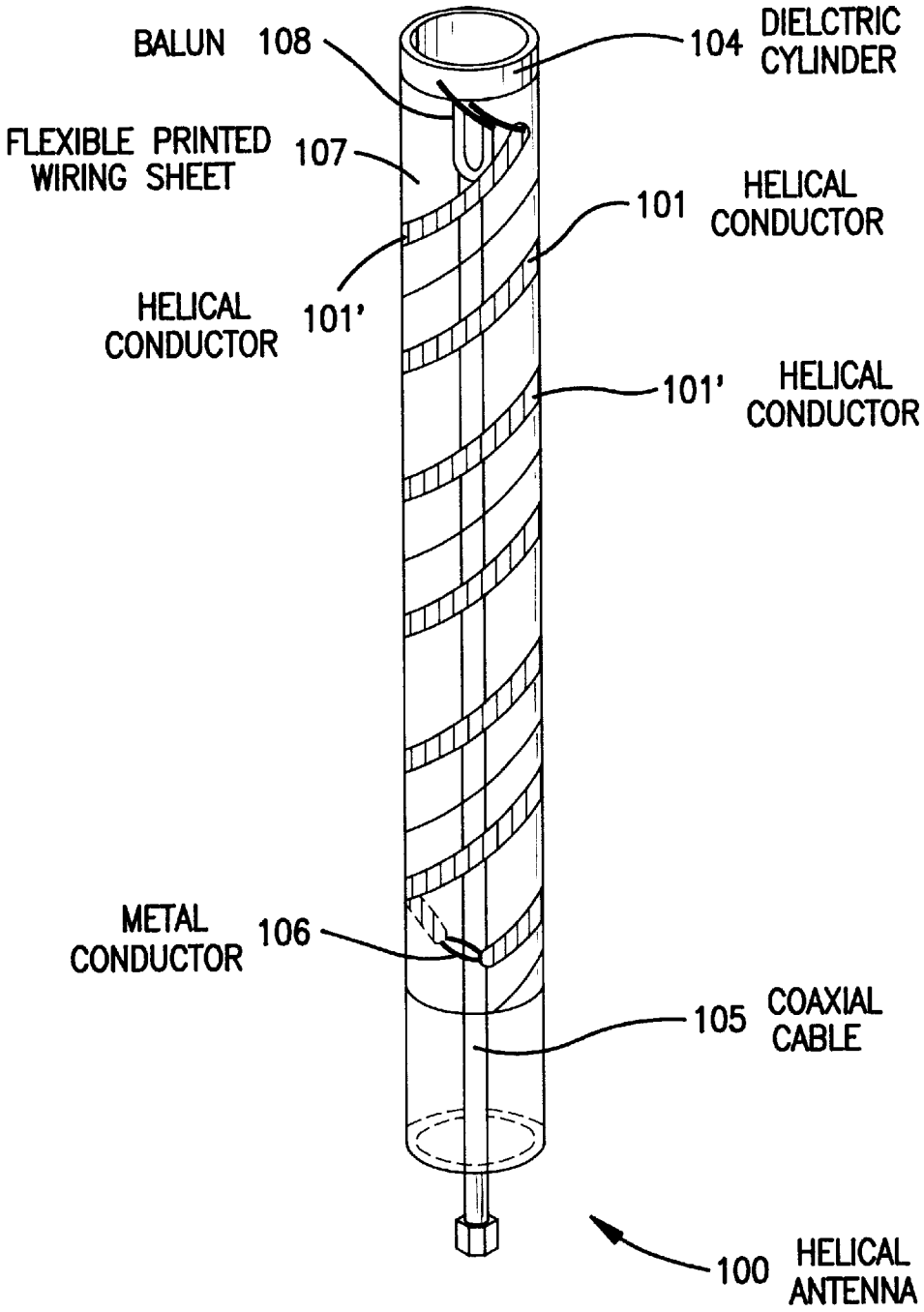
FIG. 7 PRIOR ART
FIG. 7 is a perspective view of a helical antenna 100 according to prior art.
Figure 8:
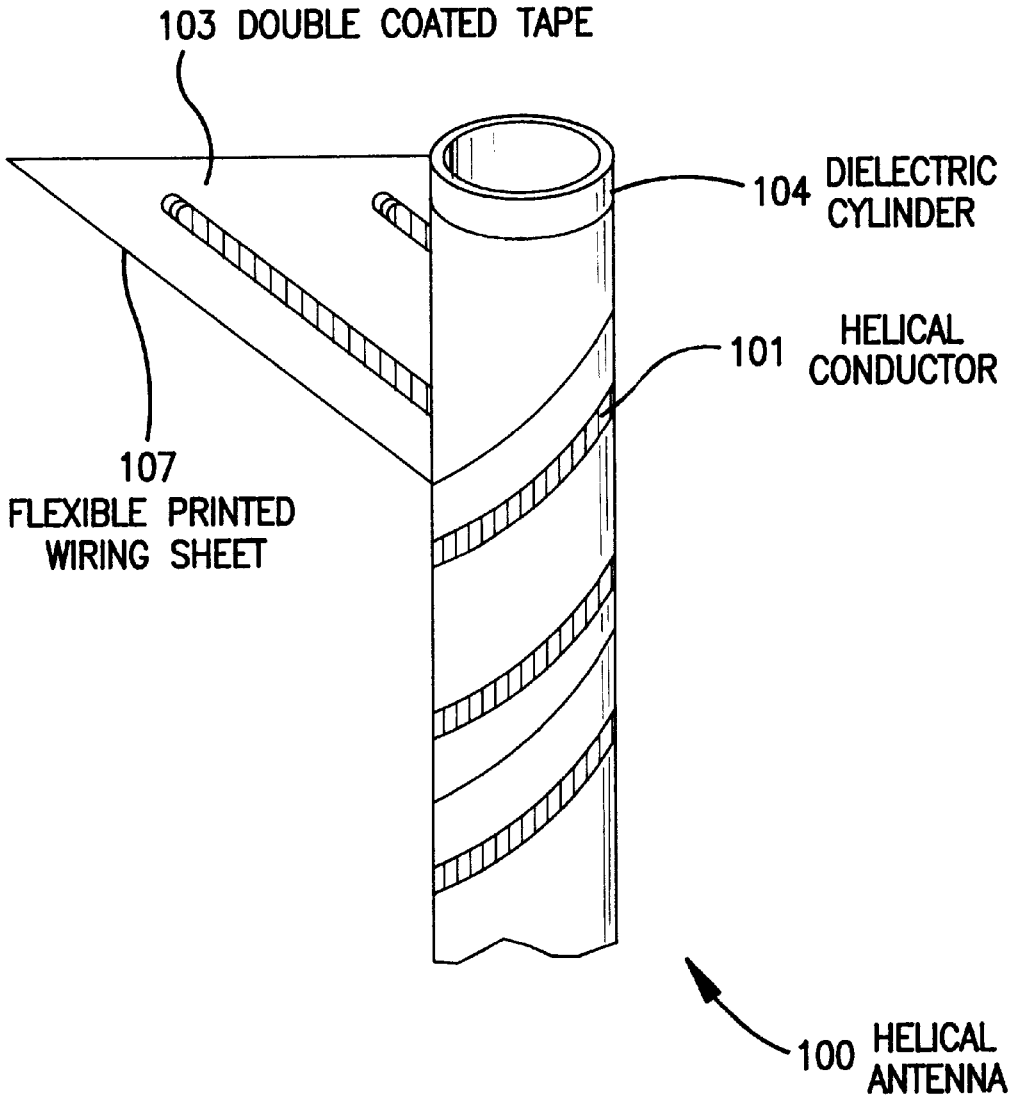
FIG. 8 PRIOR ART
FIG. 8 is a perspective view of an assembly procedure of a helical antenna 100 according to prior art.
Figure 9:
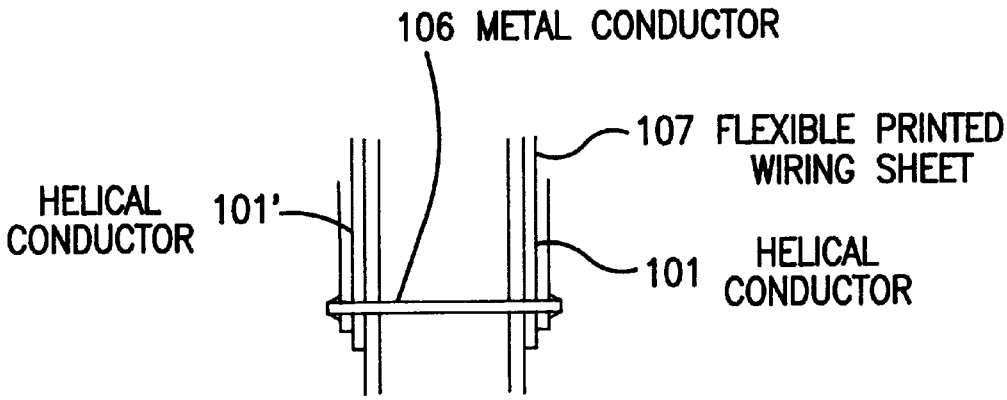
FIG. 9 PRIOR ART
FIG. 9 is a perspective view of a metal conductor 106 of a helical antenna 100 according to prior art.
Figure 10:
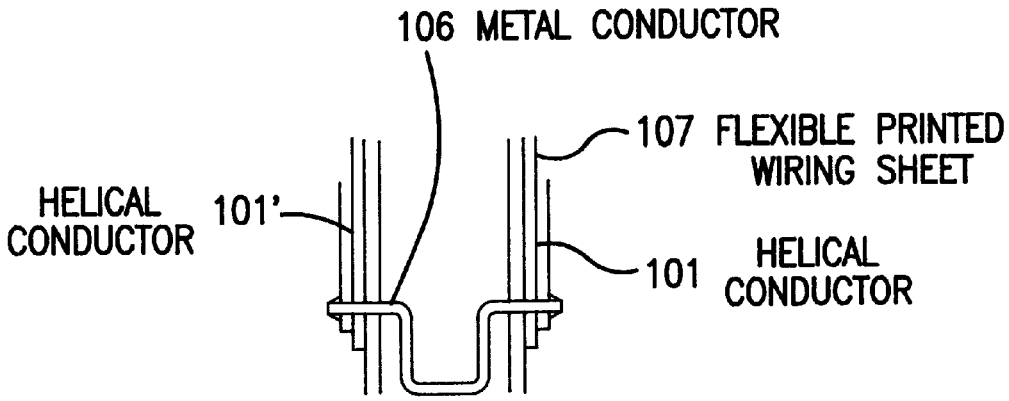
FIG. 10 PRIOR ART
FIG. 10 is a side view of another metal conductor 106 of a helical antenna 100 according to prior art.

The feeder conductors 4*a*–4*d* and the radiation conductors 2*a*–2*d* are closely arranged on opposite sides of the dielectric cylinder 1, so the feeder conductors 4*a*–4*d* and the radiation conductors 2*a*–2*d* are coupled to each other by the electrostatic capacitance; therebetween in a high frequency range. In the conventional helical antenna 100 shown in FIG. 7, the signal applied to the coaxial cable is directly connected and directly fed to the helical conductors. However, the helical antenna 10 according to the present invention is coupled through high frequency, so it is possible to adjust the matching conditions with respect to the radiation conductors 2*a*–2*d* by modifying the shape of the feeder conductors 4*a*–4*d*.

Especially, if the radiation conductors 2*a*–2*d* have inductive impedance, it is possible to attain the impedance matching effectively by cancelling the feeder impedance.

The operation of the feeder circuit 5 shown in FIG. 1 is explained below.

A high frequency (normally microwave or quasi-microwave frequency band) signal applied to a terminal 8 of feeder circuit 5 is divided into four signals S1–S4 which have phases offset from each other by 90 degrees and the same amplitude by dividers 6, 7 and 9. The divided high frequency signals S1–S4 are fed to the feeder conductors 4*a*–4*d* respectively. Such high frequency signals are fed to the radiation conductors 2*a*–2*d* through the electrostatic coupling between the feeder conductors 4*a*–4*d* and the radiation conductors 2*a*–2*d*. The high frequency signals S1–S4 fed to the radiation conductors 2*a*–2*d* radiate from the radiation conductors 2*a*–2*d*.

Details of the helical antenna 10 according to the present invention will be described below with reference to FIG. 1 through FIG. 4.

In FIG. 1, the dielectric cylinder 1 may be made of plastic such as polycarbonate resin or acrylic resin, as are conventionally used.

The dielectric cylinder 1 may have an outer diameter which is usually about 0.1λ (λ is a wavelength of an operating frequency). It is desirable that the thickness of the dielectric cylinder 1 is about 0.01λ or less. In addition, the length of the dielectric cylinder 1 is so selected that it is shorter than about 1.5λ, because such length is effective to matching of a helical antenna having a number of turns less than 2.

The radiation conductors 2 are arranged on the outer surface of the dielectric cylinder 1 and are adhered to the dielectric cylinder 1 by using a pressure sensitive adhesive double coated tape. Desirable length of the radiation conductors are about 2λ or less. If the length of the radiation conductors 2 are the same as λ or shorter, instead of a helical-shaped conductor, a straight rod-shaped conductor or a rod-shaped conductor which is straight but folded at several points may be used.

The matching conductor 3 is arranged on the inner surface of the dielectric cylinder 1.

FIG. 2 shows a locational relation of the radiation conductors 2, the dielectric cylinder 1 and the matching conductor 3.

Figure 2A:
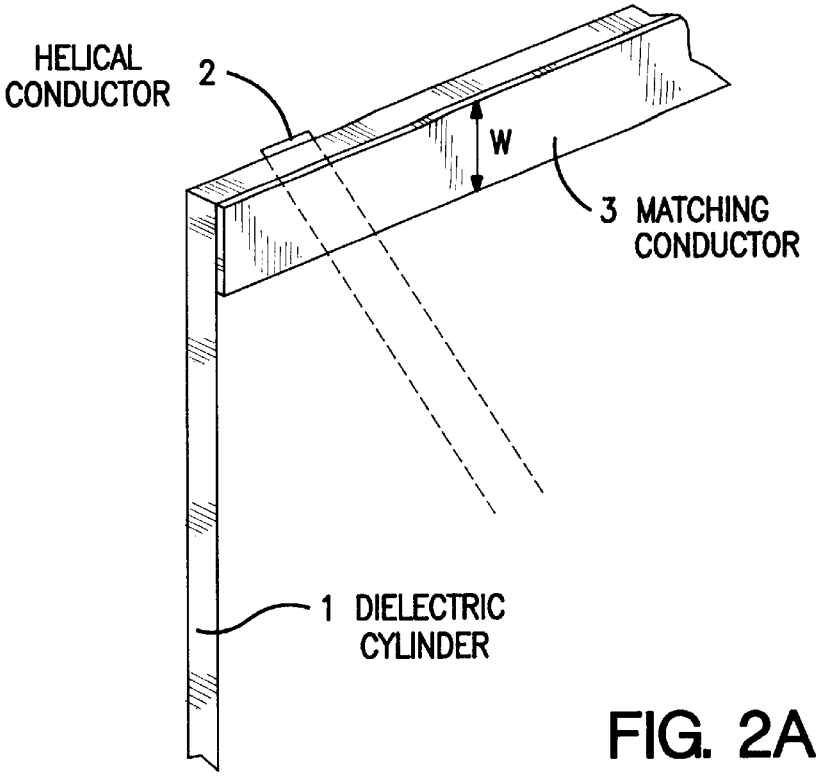
FIG. 2A is a perspective view of the upper part of a dielectric cylinder 1 of the helical antenna 10 according to the present invention, showing the cylindrical surface in one plane.
Figure 2B:
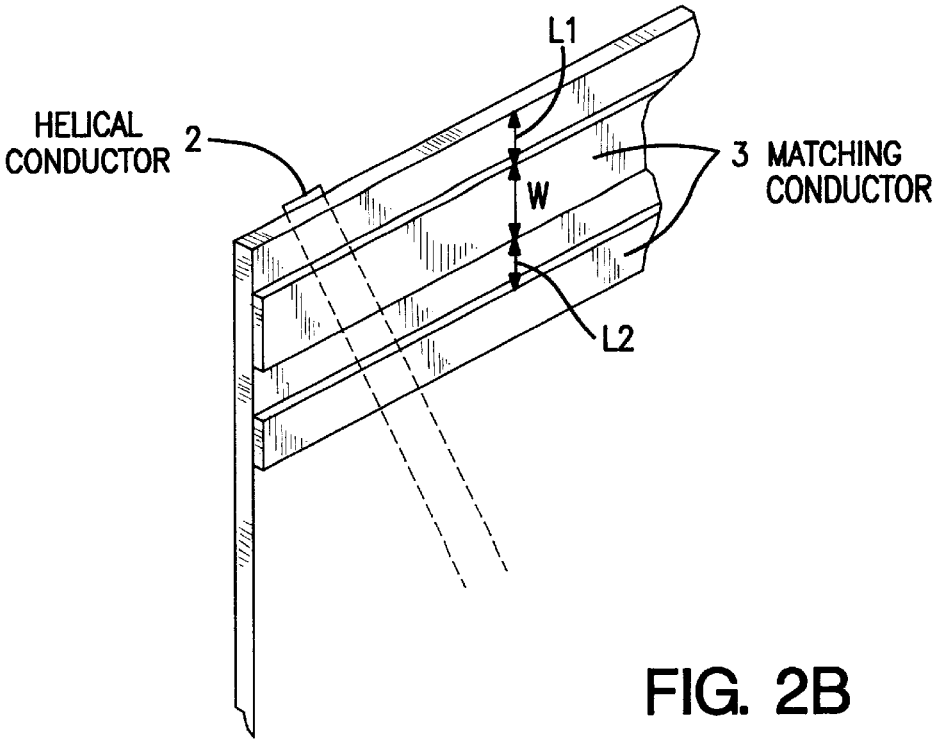
FIG. 2B is a view similar to FIG. 2A or another embodiment of the upper part of the dielectric cylinder 1 of the helical antenna 10 according to the present invention.

As shown in FIG. 2A, an impedance matching of the helical antenna 10 is attained by adjusting a width W of the matching conductor 3. Generally speaking, W is about 0.01λ–0.1λ. As shown in FIG. 2B, the matching conductor 3 may be arranged offset from the end of the dielectric cylinder 1 by a distance L1 if desired. A plurality of matching conductors may also be arranged. L1 and L2 are usually 0.2λ or shorter.

The feeder conductors 4 are arranged near the radiation conductors 2 on the lower inner surface of the dielectric cylinder 1.

Figure 3:
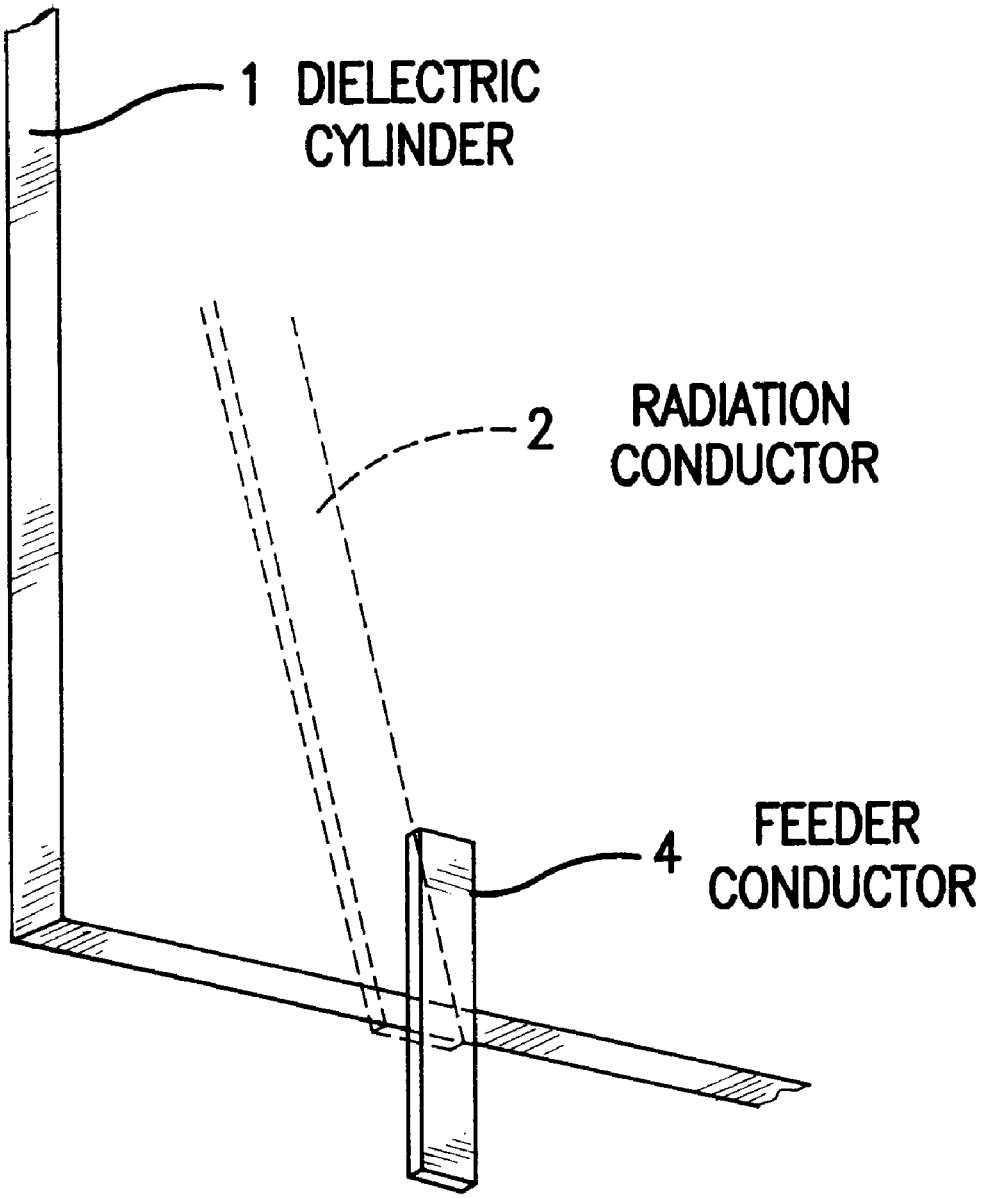
FIG. 3 is a view similar to FIG. 2A of the lower part of the dielectric cylinder 1 of a helical antenna 10 according to the present invention.

FIG. 3 shows a locational relation of the radiation conductors 2, the dielectric cylinder 1 and the feeder conductors 4. Similarly to the matching conductor 3, the feeder conductors 4 and the radiation conductors 2 are arranged with the dielectric cylinder 1 having thickness of about 0.01λ.

Figure 4A:
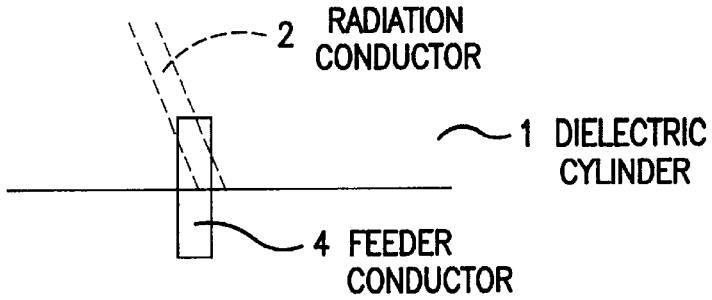
FIG. 4A is a view of a first shape of a feeder conductor 4 of the helical antenna 10 according to the present invention.
Figure 4B:
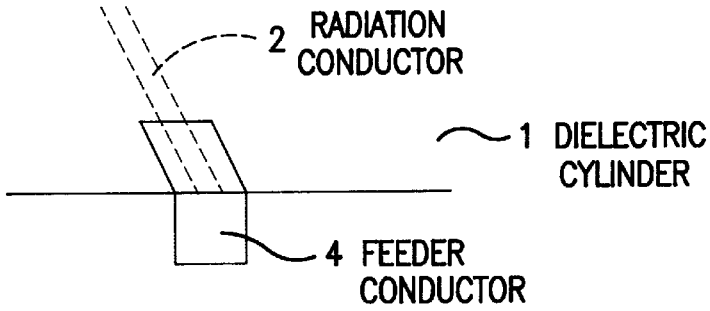
FIG. 4B is a view of a second shape of the feeder conductor 4 of the helical antenna 10 according to the present invention.
Figure 4C:
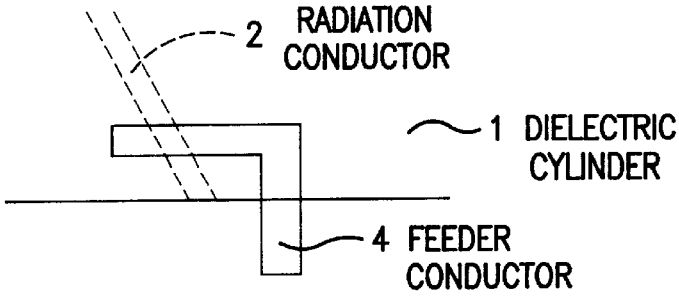
FIG. 4C is a view of a third shape of the feeder conductor 4 of the helical antenna 10 according to the present invention.
Figure 4D:
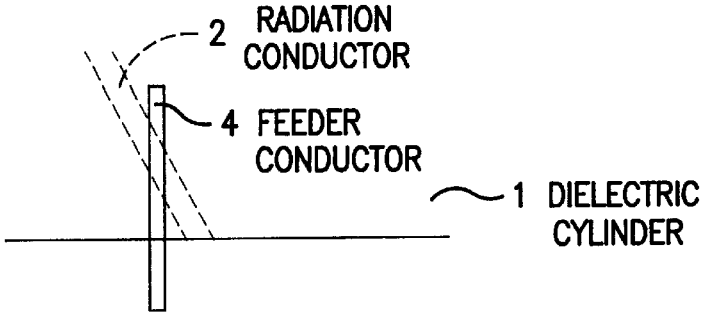
FIG. 4D is a view of a fourth shape of the feeder conductor 4 of the helical antenna 10 according to the present invention.

The feeder conductors 4 may take various shapes according to the shape of the radiation conductors as shown in FIGS. 4A–4D. That is, as shown in FIG. 4A, the feeder conductors 4 may take a rectangular shape. The feeder conductors 4 may be arranged obliquely face to face with respect to the radiation conductors 2. They may be arranged in parallel with the radiation conductors 2, as shown in FIG. 4B. They may be bent at a right angle, as shown in FIG. 4C. They may take a slender rectangular shape, as shown in FIG. 4D.

As described above, it becomes possible to change the electrostatic capacity and to adjust matching conditions with respect to the radiation conductors 2 by changing the shape of the feeder conductors 4.

These feeder conductors 4*a*–4*d* are fed in phases different by 90 degrees from each other from the feeder circuit 5.

As shown in FIG. 1, the feeder circuit 5 can be easily composed by the divider 6 and 9 having phases different by 180 degrees from each other and one divider 7 having a phase different by 90 degrees from said two dividers.

The operation of the antenna element according to the present invention will now be described.

In FIG. 1, the high frequency signal fed from the terminal of feeder circuit 8 is divided into the signals S1–S4 having phases different by 90 degrees from each other and the same amplitude by the dividers 7, 6 and 9. such is divided signals S1–S4 are fed to the feeder conductors 4*a*–4*d* respectively. Such signals are also fed to the radiation conductors 2*a*–2*d* through the electrostatic coupling between the feeder conductors 4 and the radiation conductors 2.

The high frequency signals S1–S4 fed to the radiation conductors 2*a*–2*d* are balanced signals and radiate from the radiation conductors 2*a*–2*d* respectively. In this case, to radiate the high frequency signal efficiently from the radiation conductor 2, the output impedance of four terminals of the feeder circuit 5 must be equal to the input impedance of so-called helical antenna respectively when the radiation conductors 2 are viewed from the feeder conductors 4.

However, in the case of the helical antenna 10 having a number of turns less than 2, the input imnpedance varies greatly according to the length of the radiation conductors 2. Sometimes, the absolute value of the input impedance varies over a range as wide as 30–2,000 ohms.

To the contrary, the output impedance on the feeder circuit 5 is usually about 30–300 ohms, so it is necessary to match these impedances with each other. In the case of the antenna according to the present invention, such matching is attained by means of the matching conductor 3 and the feeder conductors 4. The coupling between the matching conductor 3 and the radiation conductors 2 can be adjusted by modifying the number and the position of the matching conductor 3. At the same time, it is possible to adjust the absolute value of the input impedance of the radiation conductors 2, namely, the helical antenna itself.

The matching conductor 3 is electrostatically coupled with the radiation conductors 2*a*–2*d*. For example, when viewed from the radiation conductor 2*a*, the radiation conductors 2*b*–2*d* are effectively coupled with each other through the matching conductor 3. Therefore, even though the single radiation conductor 2*a* has narrow or high feeding impedance, such feeder impedance of the radiation conductor 2*a* can be made wider or lower by the addition of the matching conductor 3, because the admittance component is connected equivalently in parallel by the matching conductor 3.

The feeder conductors 4 are electrostatically coupled with the radiation conductors 2. If the input impedance is such that the radiation conductors 2 are inductive, impedance matching can be attained by canceling the reactance component by adjusting the degree of capacitive coupling.

In the above-mentioned embodiments, the feeder conductors 4*a*–4*d* are arranged on the lower inner wall of the dielectric cylinder 1, and the matching conductor is arranged on the upper inner wall thereof.

SECOND EMBODIMENT

Figure 5:
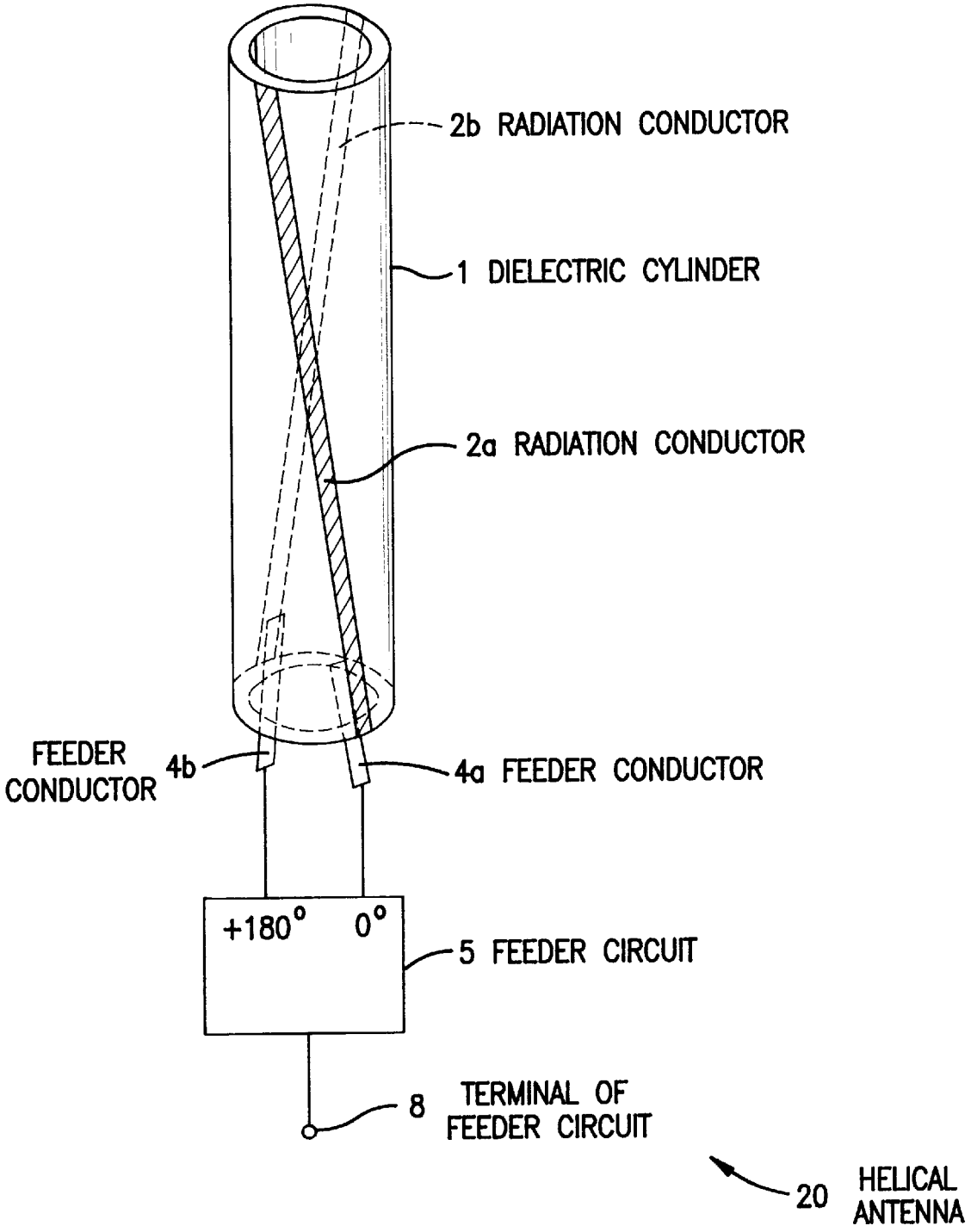
FIG. 5 is a perspective view of a helical antenna 20 of a second embodiment according to the present invention.

As shown in the perspective view of the helical antenna 20 of FIG. 5, in the second embodiment of the present invention, if electrical matching conditions can be satisfied, a configuration containing no matching conductor 3, that is, a configuration without the matching conductor 3 of FIG. 1, may be used. The configuration shown in FIG. 5 contains two radiation conductors 2*a* and 2*b*. This configuration has the advantage that the construction of the dielectric cylinder 1 can be simplified.

THIRD EMBODIMENT

Figure 6:
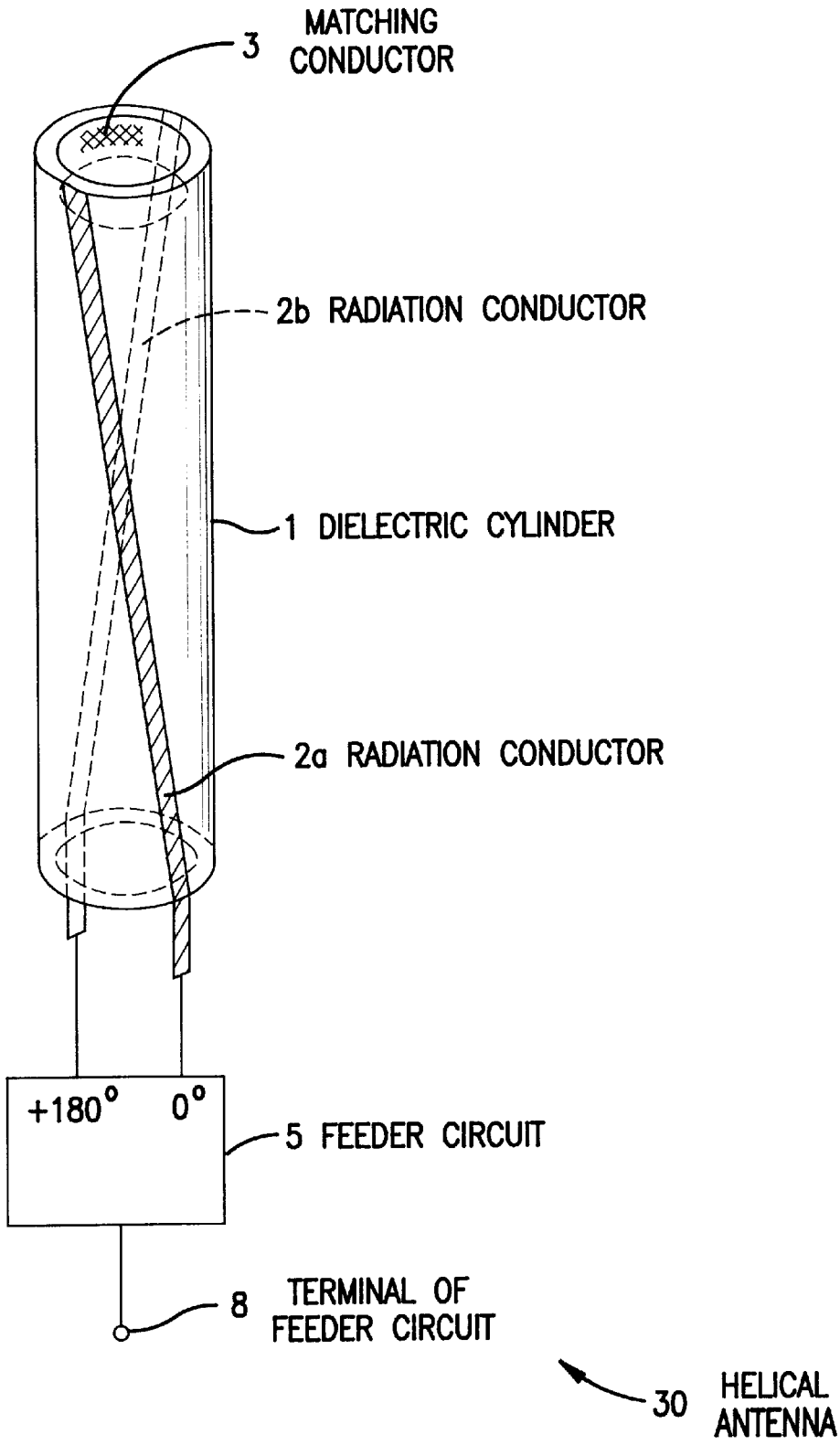
FIG. 6 is a perspective view of a helical antenna 30 of a third embodiment according to the present invention.

In the third embodiment, as shown in the perspective view of the helical antenna 30 of FIG. 6, the feeder conductors 4*a*–4*d* are not electrostatically coupled with the radiation conductors 2*a*–2*d*. They are directly coupled and electrical matching is attained by means of the matching conductor 3.

The configuration shown in FIG. 1 contains four feeder conductors 4 and four radiation conductors 2 and the feeder conductors 4 are fed in phases different by 360/4=90 degrees from each other.

However, the present invention is not limited to such configuration. Generally, if any configuration contains n (natural number more than 2) feeder conductors 4 and n radiation conductors 2, electrical energy can be fed by shifting each phase of the feeder conductors 4 by (360/n) degrees.

As described above, in the case of the helical antenna of the present invention, (1) the matching conductor arranged on the inner wall of the dielectric cylinder forming the helical antenna equipped with a plurality of the radiation conductors on its surface has an advantage to lower the feeder impedance of the radiation conductor.

(2) the feeder conductors arranged on the inner wall of the dielectric cylinder forming the helical antenna equipped with a plurality of the radiation conductors on its surface have an advantage to cancel the inductive reactance component of the feeder impedance of the radiation conductor and to lower the feeder impedance.

Therefore, in the case of a small helical antenna containing a short radiation conductor requiring broad fan radiation for a portable terminal for the mobile satellite communication and so on, due to the above-mentioned advantages, very high impedance of the helical conductor can be decreased, easy impedance matching becomes possible, VSWR is improved, and transmission efficiency and antenna gain can be enhanced.

While the present invention has been described in connection with various preferred embodiments thereof, it is to be expressly understood that these embodiments are not to be construed in a limiting sense. Instead, numerous modifications and substitutions of equivalent structure and techniques will be readily apparent to those skilled in this art after reading the present application. All such modifications and substitutions are considered to fall within the true scope and spirit of the appended claims.

What is claimed is:

1. A helical antenna having a broad and fan radiation pattern, comprising:

a plurality of feeder conductors for feeding a plurality of balanced high frequency signals to a plurality of radiation conductors in different phases respectively based on a first electrostatic coupling;

said plurality of radiation conductors radiating said balanced high frequency signals in different phases respectively;

a dielectric cylinder having said plurality of radiation conductors arranged on its outer wall and said plurality of feeder conductors arranged on and limited to its lower inner wall; and wherein said plurality of feeder conductors and said plurality of radiation conductors are arranged on opposite sides of said dielectric cylinder such that they are capacitively coupled.

2. The antenna as claimed in claim 1, wherein said plurality of feeder conductors comprises:

means for coupling electrostatically with said plurality of radiation conductors based on an electrostatic capacitance between said plurality of feeder conductors and said plurality of radiation conductors.

3. The antenna as claimed in claim 2, wherein said plurality of feeder conductors further comprises:

adjusting means for adjusting said electrostatic coupling by changing a shape of said feeder conductors.

4. The antenna as claimed in claim 1, wherein said plurality of radiation conductors have a short length and a small number of turns.

5. The antenna as claimed in claim 4, wherein said length is 1.5λ (λ is a wavelength of an operating frequency) and said number of turns is less than 2 turns.

6. The antenna as claimed in claim 1, wherein said plurality of radiation conductors are adhered to said dielectric cylinder by a pressure sensitive adhesive double coated tape.

7. The antenna as claimed in claim 1, wherein said dielectric cylinder comprises a cylinder having a diameter which is less than 0.1λ, a length which is less than 1.5λ and thickness which is less than 0.01λ.

8. The antenna as claimed in claim 1, further comprising:

a feeder circuit for feeding a plurality of signals in offset phases to said plurality of radiation conductors via a plurality of dividers.

9. A helical antenna having a broad and fan radiation pattern, comprising:

a plurality of feeder conductors for feeding a plurality of balanced high frequency signals to a plurality of radiation conductors in different phases respectively based on a first electrostatic coupling;

said plurality of radiation conductors radiating said balanced high frequency signals in different phases respectively;

a dielectric cylinder having said plurality of radiation conductors arranged on its outer wall and said plurality of feeder conductors arranged on its inner wall; and matching means connected to said plurality of radiation conductors by a second electrostatic coupling at an end of said antenna a opposite a termimal end of said antenna, for adjusting an impedance matching of said helical antenna.

10. The antenna as claimed in claim 8, wherein said second electrostatic coupling is adjusted by modifying the number and position of said matching means.

11. The antenna as claimed in claim 9, wherein said matching means comprises:

at least one conductor arranged on the inner surface of said dielectric cylinder.

12. A helical antenna having a broad fan radiation pattern, comprising:

feeder means for feeding a plurality of balanced high frequency signals directly to a plurality of radiation conductors in respectively offset phases;

said plurality of radiation conductors radiating said balanced high frequency signals in different phases;

a dielectric cylinder having said plurality of radiation conductors arranged on and limited to its lower outer wall; and wherein said plurality of feeder conductors and said plurality of radiation conductors are arranged on opposite sides of said dielectric cylinder such that they are capacitively coupled.

13. The antenna as claimed in claim 12, wherein said plurality of feeder conductors comprises:

means for coupling electrostatically with said plurality of radiation conductors based on an electrostatic capacity between said plurality of feeder conductors and said plurality of radiation conductors.

14. The antenna as claimed in claim 12, wherein said plurality of feeder conductor further comprises:

adjusting means for adjusting said electrostatic coupling by changing a shape of said feeder conductors.

15. The antenna as claimed in claim 12, wherein said plurality of radiation conductors have a short length and a small number of turns.

16. The antenna as claimed in claim 15, wherein said length is 1.5λ (λ is a wavelength of an operating frequency) and said number of turns is less than 2 turns.

17. The antenna as claimed in claim 12, wherein said plurality of radiation conductors are adhered to said dielectric cylinder by a pressure sensitive adhesive double coated tape.

18. The antenna as claimed in claim 12, wherein said dielectric cylinder comprises a cylinder having a diameter which is less than 0.1λ, a length which is less than 1.5λ and thickness which is less than 0.01λ.

19. The antenna as claimed in claim 12, further comprising:

a feeder circuit for feeding a plurality of signals in offset phases to said plurality of radiation conductors via a plurality of dividers.

20. A helical antenna having a broad fan radiation pattern, comprising:

feeder means for feeding a plurality of balanced high frequency signals directly to a plurality of radiation conductors in respectively offset phases;

said plurality of radiation conductors radiating said balanced high frequency signals in different phases;

a dielectric cylinder having said plurality of radiation conductors arranged on its outer wall; and matching means connected to said plurality of radiation conductors by an electrostatic coupling located at an end of said antenna opposite a terminal end of said antenna, for adjusting an impedance matching of said helical antenna.

21. The antenna claimed in claim 20, wherein said electrostatic coupling is adjusted by modifying the number and position of said matching means.

22. The antenna as claimed in claim 20, wherein said matching means comprises:

at least one conductor arranged on the inner surface of said dielectric cylinder.

23. A helical antenna having a non-directional radiation pattern, comprising:

N feeder conductors (wherein N is positive integer) for feeding a plurality of balanced high frequency signals to a plurality of radiation conductors in phases offset by 2 π/N respectively based on a first electrostatic coupling;

said plurality of radiation conductors for radiating said balanced high frequency signal in said phases respectively;

a dielectric cylinder having said plurality of radiation conductors arranged on its outer wall and said N feeder conductors arranged on and limited to its lower inner wall; and wherein said plurality of feeder conductors and said plurality of radiation conductors are arranged on opposite sides of said dielectric cylinder such that they are capacitively coupled.

* * * * *